US007682260B1

(12) United States Patent
Whitlock et al.

(10) Patent No.: US 7,682,260 B1
(45) Date of Patent: Mar. 23, 2010

(54) SYSTEM FOR ANCHORING INFLATABLE STRUCTURES

(76) Inventors: William N. Whitlock, 5208 Calle de Rio, Siesta Key, FL (US) 34242; Charles Brewer, 2550 Industrial Park Blvd., Linn Creek, MO (US) 65052

( * ) Notice: Subject to any disclaimer, the term of this patent is extended or adjusted under 35 U.S.C. 154(b) by 40 days.

(21) Appl. No.: 11/442,636

(22) Filed: May 25, 2006

Related U.S. Application Data

(60) Provisional application No. 60/685,223, filed on May 27, 2005.

(51) Int. Cl.
*A63G 31/12* (2006.01)
*B63B 7/00* (2006.01)

(52) U.S. Cl. ..... 472/134; 472/116; 472/117; 114/345

(58) Field of Classification Search ..... 472/116–128, 472/134, 136; 405/115; 52/2.25, 2.26; 441/40, 441/66; 4/488, 494, 507
See application file for complete search history.

(56) References Cited

U.S. PATENT DOCUMENTS 3,363,268 A * 1/1968 Friedlander ..... 4/506
4,369,591 A 1/1983 Vicino
4,606,728 A * 8/1986 Simpson ..... 441/66
4,662,301 A 5/1987 Wolfe
5,059,065 A * 10/1991 Doolaege ..... 405/115
5,135,440 A 8/1992 Smollar et al.
6,008,938 A 12/1999 Suehle et al.
6,062,983 A * 5/2000 Butsook ..... 472/117
6,152,530 A * 11/2000 Hsu et al. ..... 297/272.3
6,192,528 B1 * 2/2001 Martinez ..... 4/507
6,375,145 B1 4/2002 Payne
6,481,928 B1 * 11/2002 Doolaege ..... 405/115
6,997,133 B1 * 2/2006 Song et al. ..... 114/345

* cited by examiner

*Primary Examiner*—Kien T Nguyen
(74) *Attorney, Agent, or Firm*—Thorpe North & Western LLP

(57) ABSTRACT

A system for anchoring inflatable structures having a base which, when the structure is inflated, rests on a supporting surface to support the structure, includes at least one water receiving anchoring portion positioned adjacent a side of the base of the structure that rests on the supporting surface and which is secured to and extends from the inflatable structure. The water receiving anchoring portion includes a water receiving section to receive water therein and a shaping section to provide a shape to the water receiving section and to the water receiving anchoring portion to ease filling of the water receiving section with water. The shaping section shapes the water receiving section generally into a cup or bucket like structure so that water can be poured into the water receiving section without the water receiving section being held in such shape by hand or without having to be filled with pressurized water.

22 Claims, 2 Drawing Sheets

SYSTEM FOR ANCHORING INFLATABLE STRUCTURES

RELATED APPLICATION

Figure 1:
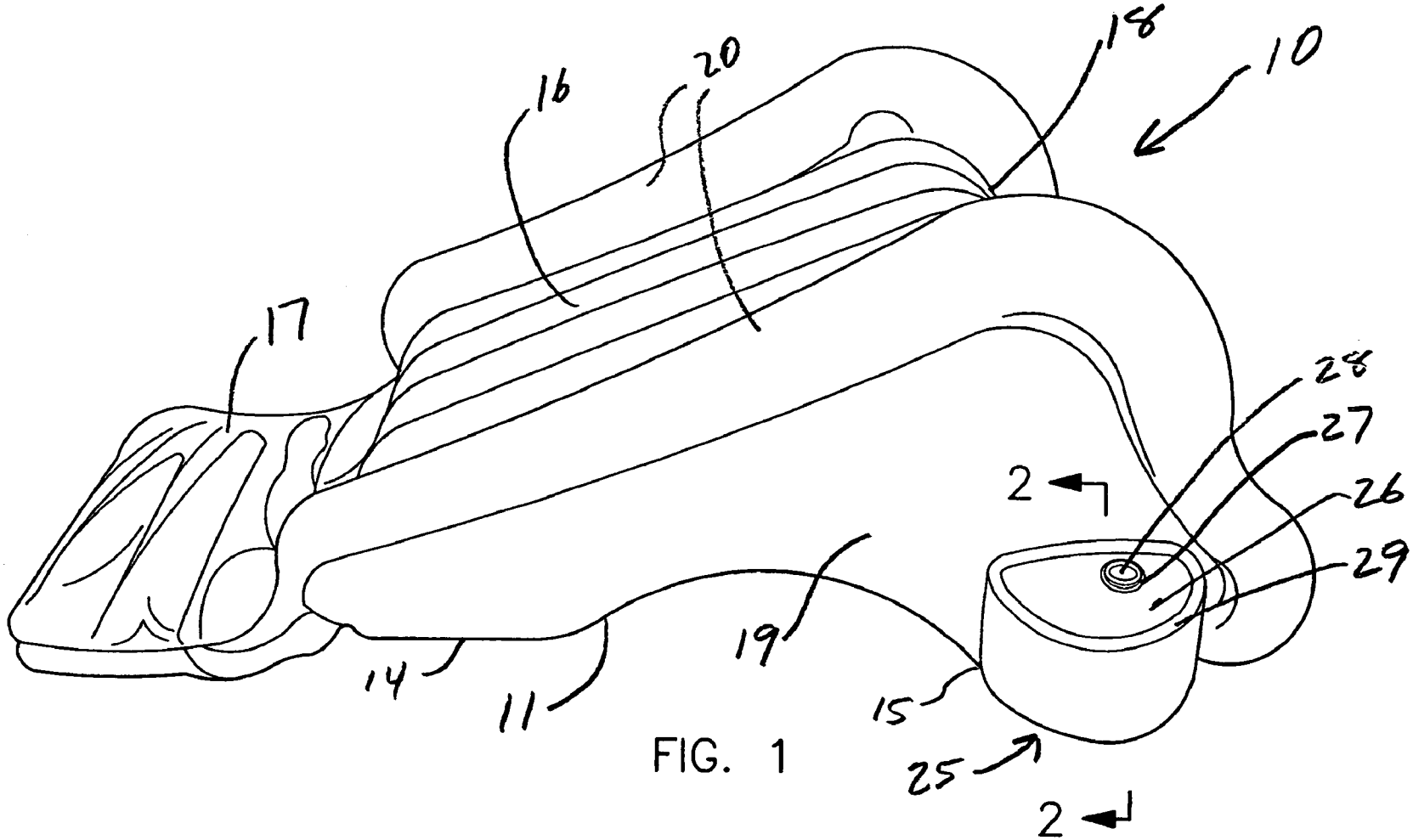

This application claims the benefit of provisional Application Ser. No. 60/685,223, filed May 27, 2005, and entitled System For Anchoring Inflatable Structures.

BACKGROUND OF THE INVENTION

1. Field

The invention is in the field of inflatable devices such as inflatable recreation devices, for example, inflatable slides, which sit on a surface.

2. State of the Art

There are numerous inflatable structures in wide use today, particularly inflatable play structures, such as inflatable slides, and inflatable advertising structures, such as inflatable structures that form a surface for placing advertising signs or inflatable structures in various shapes, such as animal or other shapes, that are placed at a businesses to draw attention to the business. These structures have a base which rests on a supporting surface such as the ground, a deck, or a floor, and may be relatively light weight because they are hollow and filled with air. Because these structures may be relatively light and relatively large, they are subject to being blown around in wind when out doors. Further, if a play structure, they can be easily rocked and moved when being played on. A stabilizing or anchoring system for such structures is needed that can be easily used.

U.S. Pat. No. 4,369,591 shows an inflatable display structure that includes longitudinally extended water bladders inside the device secured to and resting on the base to provide weight to stabilize and anchor the structure. The bladders have a hose bib attached for filling the bladders with water and a drain for draining the bladders. In filling the bladders, it is necessary to connect a hose to the hose bib and supply pressurized water to the bladder to fill it. The patent also indicates that such bladders can be positioned externally to the structure and fastened to the structure with stays. U.S. Pat. No. 6,008,938 shows an inflatable projection screen and teaches that the structure may be secured to the ground with stakes and tethers, or alternatively, the tethers may be secured to concrete blocks or water-filled drums or bladders. In either case, where the bladders are used, the bladders are not easily filled with water without a pressurized source of water that can be attached to the inlet of the bladder. Thus, U.S. Pat. No. 4,369,591 provides hose bibs in the bladder to connect a hose thereto for filling the bladder. Further, when not positioned internally of the structure, the bladders are connected to the structure by stays or tethers and are not part of the structure. This lessens the stabilizing effect of the bladders and makes connection of the bladders difficult. Bladders within the structure, while holding the structure in a wind, often are not positioned to provide stabilization if the structure is played upon.

An improved, easy to use water stabilizing system is needed.

SUMMARY OF THE INVENTION

According to the invention, an inflatable structure having a base which rests on a supporting surface which supports the structure includes at least one water receiving anchoring portion positioned adjacent a side of the base of the structure that rests on the supporting surface and which is secured to and extends from the inflatable structure as part of the structure. The anchoring portion includes a shaping section which shapes a water receiving section. The shaping section may be inflatable, such as an inflatable peripheral section partially or substantially fully surrounding the water receiving section so as to provide shape to the water receiving section to ease filling of the water receiving section with water. The inflatable shaping section may be in fluid communication with the inflatable structure to inflate with inflation of the inflatable structure or may be separately inflatable. A valve, such as an opening with a sealing plug therefor, is preferably provided into the water receiving section to allow filling and emptying of the water receiving section when the plug is removed and the opening is open and sealing the water receiving section when the plug is in place in the opening, or the valve is otherwise closed to hold water therein.

Preferably, at least two water receiving portions are provided as part of the inflatable structure with such portions located on opposite sides of the structure. The water receiving portions provide increased weight to the inflatable structure for stabilizing and anchoring the structure, and providing the additional weight beyond the sides of the structure rather than inside the structure provides increased stabilization of the structure against tipping.

THE DRAWINGS

Figure 2:
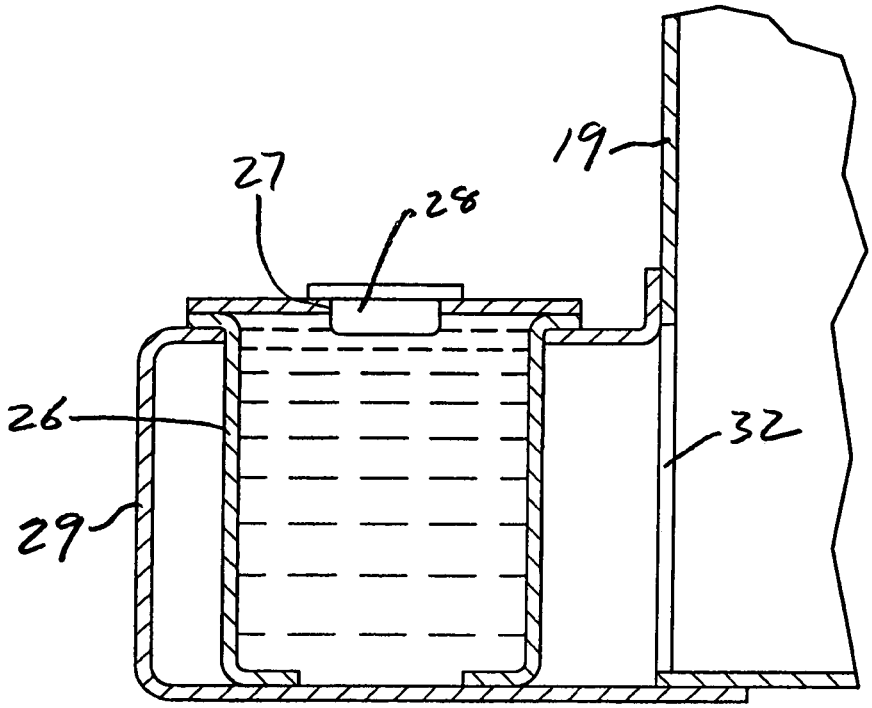

In the accompanying drawings, which show the best mode currently contemplated for carrying out the invention:

FIG. 1 is a pictorial view of an inflatable slide with an anchoring device of the invention;

FIG. 2, a vertical section taken on the line 2-2 of FIG. 1; and

Figure 3:
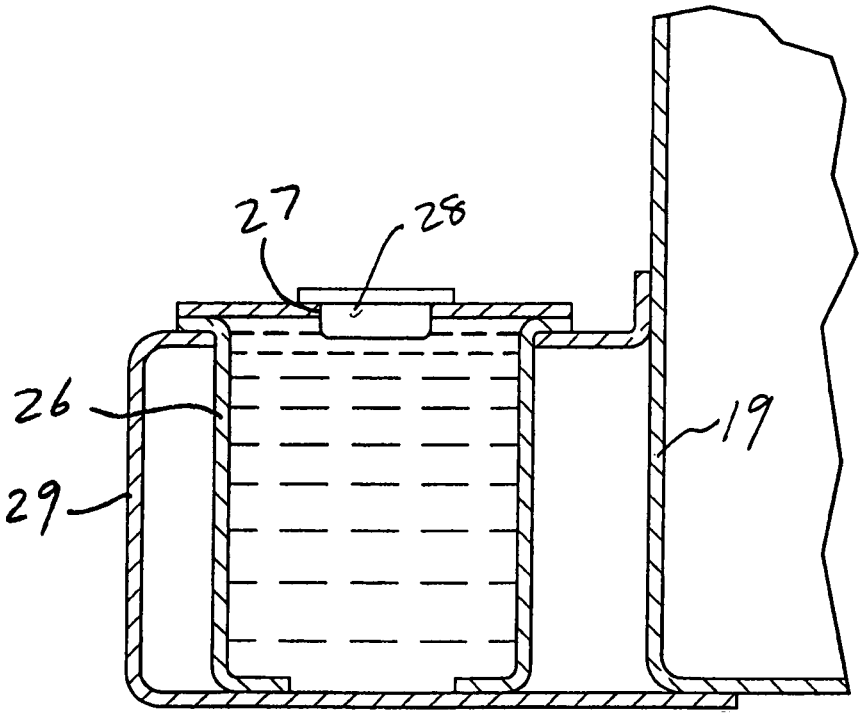

FIG. 3, a vertical section similar to that of FIG. 2, but showing a different embodiment.

DETAILED DESCRIPTION OF THE INVENTION

The invention is shown and described in connection with an inflatable slide structure, however, this is merely an example of an inflatable structure with which the invention can be used and the invention can be used with a wide variety of other inflatable structures. As shown in FIG. 1, the inflatable structure of the example is an inflatable slide having a generally wedge shaped body 10 with a base 111 which rests on a supporting surface such as a deck around a swimming pool. The slide could also be supported indoors on a floor or outside on the ground, such as on a lawn. In the slide shown, the base has a front base portion 14 and a rear base portion 15 which contact and rest on the supporting surface. The slide has an inclined upper surface 16, a front pad extension 17, a rear wall 18, and a pair of side walls 19. A pair of side rails 20 are formed along the sides of the inclined upper surface 16. A user can climb rear wall 18 and then slide down inclined sliding surface 16 and pad extension 17 into a swimming pool or onto whatever surface supports the slide. The pad extension 17 provides a transition from the sliding surface 16 to either the water or other supporting surface.

During use, the slide has a tendency to move on the supporting surface and to tip as users move around on the slide. The slide also can be blown along the supporting surface in a wind. To lessen the relative movement of the slide with respect to the supporting surface during use and during a wind, water receiving portions 25 are provided extending from the slide body adjacent the rear portions of opposite sides of the base of the slide, only one of the water receiving portions being shown in FIG. 1. While water receiving anchoring portion 25 is shown at the rear portion of the slide, such water receiving anchoring portions could be placed at the forward portion of the slide or at both the rear and forward portions of the slide. The number and location of the water receiving anchoring portions used will depend on the particular item being anchored and the anchoring necessary or desired.

The water receiving portions 25 of the slide structure each have a water receiving section 26 with sealable opening 27 which can be opened by removal of plug 28 from opening 27 so that water receiving section 26 can be filled with water or can be emptied of water. The water receiving portions also each have shaping sections which provide shape to the water receiving sections 26. In the embodiment illustrated, the shaping sections take the form of inflatable shaping sections 29 extending peripherally around the water receiving sections 26. The shaping sections could also take the form of a shaping section extending partially around water receiving section 26. In the embodiment shown where the water receiving portion 25 extends from structure vertical side wall 19, such vertical side wall 19 could support the attached side of the water receiving portion 25, with inflatable shaping section 29 shaping and supporting the opposite side of the water receiving section 26 of water receiving portion 25. The shaping sections which shape the water receiving sections make the water receiving sections easy for a user to fill. Thus, in the embodiment shown, the shaping section 29, which itself is a peripheral section either fully or partially surrounding the water receiving section 26, and which, if only partially surrounding the water receiving section 26, it, in combination with the respective side wall 19 from which the water receiving portion extends, together fully surround the water receiving section 26, and give the water receiving section a cup or bucket shape to easily hold water when water is poured in through opening 27. If the water receiving portion was merely a shapeless bladder without side support (shaping) when not filled with water, it would be difficult for a user to fill the water receiving portion with water because the user would have to hold up the edges of the water receiving portion to form the cup or bucket receiving shape to hold water while at the same time filling the water receiving portion with water through opening 27. Otherwise, the water would not fill up the water receiving portion as it would have no water holding shape. The user would also have to hold and manually shape the water receiving portion 26 until the opening 27 was closed by the insertion of plug 28 to prevent water from running out of the water receiving portion. With the water receiving portion including both a water receiving section and a shaping section, the water receiving section will generally hold water therein upon filling without closing the opening to the section. The closure for the opening is provided to prevent discharge of water from the water receiving section during use of the inflatable structure when pressure may be applied to the water holding section during movement and tipping of the inflatable structure.

While the shaping section is shown in this embodiment as including both shaping section 29 and wall 19 so as to peripherally surround the water receiving section 26, the shaping section could merely be the wall portion of the structure if it provides sufficient shape to the water receiving section for easy filling or could merely partially surround the water receiving section if it provides sufficient shape to the water receiving section, as shaping section 29 extending from wall 19 would do without the wall 19. It is currently preferred that the shaping section substantially surround the water receiving section to provide good shaping support. The shaping section, if inflatable, may be in fluid communication with the inflatable structure from which the water receiving portions extend so, as shown in FIG. 2, is inflated along with the inflatable structure when it is inflated. As shown in FIG. 2, inflatable shaping section 29 of the water receiving anchoring portion 25, is in fluid communication through opening 32 in inflatable slide structure side wall 19 so that when the inflatable slide structure is inflated, inflatable shaping section 29 is also inflated to give shape to water receiving anchoring portion 25, specifically to water receiving section 26. Alternately, as shown in FIG. 3, inflatable shaping section 29 may be separate from and separately inflated from the inflatable structure. As shown in FIG. 3, water receiving anchoring portion 25 is secured to and extends from the slide structure vertical wall 19 without fluid communication with the inflatable slide structure. In such instance, a separate sealable opening or valve, not shown, is provided for inflating the shaping section 29. As a further alternative, a part of the shaping section can be inflated with the inflatable structure, such as a wall of the inflatable structure, and a part thereof separately inflated.

Depending upon the inflatable structure and the size of the water receiving portion, a single water receiving portion may be provided extending from the inflatable structure and be sufficient to provide the desired stabilizing and anchoring of the inflatable structure, or more than one water receiving portion may be required. It has been found for the slide structure illustrated, which may have a tendency to tip if the weight of a user at the top of the slide is off center, that two water receiving portions, each extending from opposite sides of the base near the rear of the structure, are sufficient to anchor and stabilize the slide structure. Any number of water receiving portions can be provided. Providing the water receiving portions so they extend from the sides of the base of the inflatable structure rather than being inside the inflatable structure provides increased stability for the structure to keep it from tipping. This is because of the increased distance between the added water weight.

The water receiving portion of the inflatable structure can be formed in any manner and can be secured, such as by gluing, welding, or any other known method, to the inflatable structure or can be formed as a single piece with the inflatable structure. In either case, the water receiving portion of the inflatable structure is an integral part of the inflatable structure, not a separate item tied to or secured with stays to the inflatable structure.

While the shaping section is shown as inflatable, it is only necessary that the shaping section of the water receiving anchoring portion be such as to shape the water receiving section to receive and hold water. Thus, the shaping section could, for example, be a substantially rigid material such as a substantially rigid plastic. The inflatable shaping section works well with an inflatable structure to be stabilized and collapses similarly to the rest of the structure for storage.

Whereas this invention is here illustrated and described with reference to embodiments thereof presently contemplated as the best mode of carrying out the invention in actual practice, it is to be realized that various changes may be made in adapting the invention to different embodiments without departing from the inventive concepts disclosed herein.

The invention claimed is:

1. A system for anchoring inflatable structures, comprising:

an inflatable structure to be anchored, said inflatable structure having a base which, when the structure is inflated, rests on a supporting surface to support the structure;

at least one water receiving anchoring portion positioned adjacent a side of the base of the structure that rests on the supporting surface and which is secured to and extends from the inflatable structure;

a water receiving section in the at least one water receiving anchoring portion to receive water therein; and a shaping section in the at least one water receiving anchoring portion to provide to the water receiving section of the at least one water receiving anchoring portion a cup-like shape adapted to receive water poured thereinto to ease filling of the water receiving section with water.

2. A system for anchoring inflatable structures according to claim 1, wherein the shaping section is an inflatable section which is inflated to provide a shape to the water receiving anchoring portion.

3. A system for anchoring inflatable structures according to claim 2, wherein the inflatable shaping section is in fluid communication with the inflatable structure to be inflated when the inflatable structure is inflated.

4. A system for anchoring inflatable structures according to claim 3, wherein the inflatable shaping section is a peripheral section at least partially surrounding the water receiving section.

5. A system for anchoring inflatable structures according to claim 4, wherein the inflatable shaping section is a peripheral section substantially surrounding the water receiving section.

6. A system for anchoring inflatable structures according to claim 5, wherein the water receiving section includes a valve which is opened to fill or drain the water receiving section and closed to hold water in the water receiving section.

7. A system for anchoring inflatable structures according to claim 2, wherein the inflatable shaping section is not in fluid communication with the inflatable structure and includes a valve through which the inflatable shaping section is inflated separately from the inflatable structure.

8. A system for anchoring inflatable structures according to claim 7, wherein the inflatable shaping section is a peripheral section at least partially surrounding the water receiving section.

9. A system for anchoring inflatable structures according to claim 8, wherein the inflatable shaping section is a peripheral section substantially surrounding the water receiving section.

10. A system for anchoring inflatable structures according to claim 9, wherein the water receiving section includes a valve which is opened to fill or drain the water receiving section and closed to hold water in the water receiving section.

11. A system for anchoring inflatable structures according to claim 1, wherein the water receiving section includes a valve which is opened to fill or drain the water receiving section and closed to hold water in the water receiving section.

12. A system for anchoring inflatable structures, comprising:

an inflatable structure to be anchored, said inflatable structure having a base with a substantially flat base bottom surface portion which, when the inflatable structure is inflated, is adapted to rest on a solid supporting surface to support the inflatable structure;

at least one water receiving anchoring portion positioned adjacent a side of the base of the inflatable structure that rests on the solid supporting surface and which is secured to and extends from the inflatable structure, said at least one water receiving anchoring portion having an anchoring bottom surface substantially aligned with the substantially flat base bottom surface portion and adapted to also rest on the solid supporting surface when the base is resting on the solid supporting surface to resist movement of the inflatable structure with respect to the solid surface;

a water receiving section in the at least one water receiving anchoring portion to receive water therein; and a shaping section in the at least one water receiving anchoring portion to provide a water receiving shape to the water receiving section of the at least one water receiving anchoring portion to ease filling of the water receiving section with water.

13. A system for anchoring inflatable structures according to claim 12, wherein the shaping section is an inflatable section which is inflated to provide the water receiving shape to the water receiving anchoring portion prior to filling the water receiving section with water, and wherein the inflatable shaping section is in fluid communication with the inflatable structure to be inflated when the inflatable structure is inflated.

14. A system for anchoring inflatable structures according to claim 12, wherein the shaping section is an inflatable section which is inflated to provide the water receiving shape to the water receiving anchoring portion prior to filling the water receiving section with water, and wherein the inflatable shaping section is not in fluid communication with the inflatable structure and includes a valve through which the inflatable shaping section is inflated separately from the inflatable structure.

15. A system for anchoring inflatable structures according to claim 12, wherein the at least one water receiving anchoring portion is secured to the inflatable slide body along a portion thereof which forms the shaping section of the water receiving anchoring portion when the inflatable slide body is inflated.

16. A system for anchoring inflatable structures according to claim 12, wherein the water receiving section includes a valve which is opened to fill or drain the water receiving section and closed to hold water in the water receiving section.

17. An inflatable slide play structure, comprising:

an inflatable slide body having a base with a substantially flat base bottom portion surface which, when the slide body is inflated, is adapted to rest on a solid supporting surface and having a downwardly sloped sliding surface along which a user can slide from a top end to a bottom end thereof;

at least one water receiving anchoring portion positioned adjacent a side of the base of the inflatable slide body that rests on the solid supporting surface and which is secured to and extends from the inflatable slide body, said at least one water receiving anchoring portion having an anchoring bottom surface substantially aligned with the substantially flat base bottom portion surface and adapted to also rest on the solid supporting surface to resist movement of the inflatable slide body with respect to the solid supporting surface;

a water receiving section in the at least one water receiving anchoring portion to receive water therein; and a shaping section in the at least one water receiving anchoring portion to provide a water receiving shape to the water receiving section of the at least one water receiving anchoring portion to ease filling of the water receiving section with water.

18. An inflatable slide play structure according to claim 17, wherein the shaping section is an inflatable section which is inflated to provide the water receiving shape to the water receiving anchoring portion prior to filling the water receiving section with water, and wherein the inflatable shaping section is in fluid communication with the inflatable slide body to be inflated when the inflatable slide body is inflated.

19. An inflatable slide play structure according to claim 17, wherein the shaping section is an inflatable section which is inflated to provide the water receiving shape to the water receiving anchoring portion prior to filling the water receiving section with water, and wherein the inflatable shaping section is not in fluid communication with the inflatable slide body and includes a valve through which the inflatable shaping section is inflated separately from the inflatable slide body.

20. An inflatable slide play structure according to claim 17, wherein the at least one water receiving anchoring portion is secured to the inflatable slide body along a portion thereof which forms the shaping section of the water receiving anchoring portion when the inflatable slide body is inflated.

21. An inflatable slide play structure according to claim 17, wherein the water receiving section includes a valve which is opened to fill or drain the water receiving section and closed to hold water in the water receiving section.

22. An inflatable slide play structure according to claim 17, wherein the inflatable slide body has opposite sides, and wherein the at least one water receiving anchoring portion is at least two water receiving anchoring portions with at least one water receiving anchoring portion adjacent one of the opposite sides and at least one water receiving anchoring portion adjacent the other opposite side.

* * * * *